US011452668B2

(12) United States Patent
Farulla et al.

(10) Patent No.: US 11,452,668 B2
(45) Date of Patent: Sep. 27, 2022

(54) MASSAGE ROPE

(71) Applicants: Cole Anthony Farulla, Wayne, NJ (US); Sophia Kim, Wayne, NJ (US); Dominic Rojek, Wayne, NJ (US); Mia Sarcev, Wayne, NJ (US); Tram Le Bao Tran, Wayne, NJ (US)

(72) Inventors: Cole Anthony Farulla, Wayne, NJ (US); Sophia Kim, Wayne, NJ (US); Dominic Rojek, Wayne, NJ (US); Mia Sarcev, Wayne, NJ (US); Tram Le Bao Tran, Wayne, NJ (US)

( * ) Notice: Subject to any disclaimer, the term of this patent is extended or adjusted under 35 U.S.C. 154(b) by 498 days.

(21) Appl. No.: 15/487,500

(22) Filed: Apr. 14, 2017

(65) Prior Publication Data

US 2018/0296431 A1 Oct. 18, 2018

(51) Int. Cl.
*A61H 15/00* (2006.01)

(52) U.S. Cl.
CPC . *A61H 15/0092* (2013.01); *A61H 2015/0014* (2013.01); *A61H 2201/1253* (2013.01); *A61H 2201/1671* (2013.01)

(58) Field of Classification Search
CPC ..... A61H 2015/005; A61H 2015/0064; A61H 2015/0057; A61H 2015/0014; A61H 2015/0406; A61H 2015/003; A61H 15/0092; A61H 15/0085; A61H 2201/1253
See application file for complete search history.

(56) References Cited

U.S. PATENT DOCUMENTS 1,353,761 A * 9/1920 Knoche ..... D05B 91/14 242/118.4
2,227,724 A * 1/1941 Kosa, Sr. ..... A61H 15/0092 601/132
2,390,505 A * 12/1945 Borgelt ..... D07B 7/182 57/23

(Continued)

FOREIGN PATENT DOCUMENTS

DE 9401302 U1 * 4/1994 ..... A61H 11/00

OTHER PUBLICATIONS

Instructables, "Useful & Durable 7 Strand Rope (cord) from Plastic Shopping Bags", archived from the web Mar. 6, 2015 https://web.archive.org/web/20150306050104/https://www.instructables.com/id/Useful-Rope-or-Cord-from-Plastic-Shopping-Bags/ (Year: 2015).*

(Continued)

*Primary Examiner* — Samchuan C Yao
*Assistant Examiner* — Cana A Gallegos
(74) *Attorney, Agent, or Firm* — Nelson Mullins Riley & Scarborough LLP

(57) ABSTRACT

A massage rope is provided. The massage rope may include a first rope, a second rope, a first handle operably coupled the first rope and the second rope, a second handle operably coupled to the first rope and the second rope, and a first massage spool assembly. The first massage spool assembly may include a first spool secured to the first rope and the second rope, a first spool securing string connected to the first rope and the second rope, and a second spool securing string connected to the first rope and the second rope. The first spool securing string and the second spool securing string may secure the first spool to the first rope and the second rope such that the first spool is permitted to rotate relative to the first rope and the second rope.

12 Claims, 3 Drawing Sheets

(56) References Cited

U.S. PATENT DOCUMENTS

| | | | | | |
|---|---|---|---|---|---|
| 3,672,358 | A * | 6/1972 | Majewski | A61H 15/0092 | 601/132 |
| 4,191,009 | A * | 3/1980 | Thomson | D07B 7/169 | 57/202 |
| 5,588,953 | A * | 12/1996 | Chang | A61H 15/0092 | 601/120 |
| 5,676,638 | A * | 10/1997 | Shefi | A61H 11/00 | 601/124 |
| 7,367,483 | B2 * | 5/2008 | Nassanian | A45F 3/12 | 224/264 |
| 2004/0097349 | A1 * | 5/2004 | Rogers | A63B 21/1663 | 482/91 |
| 2012/0059293 | A1 * | 3/2012 | Collins | A61H 15/0092 | 601/46 |
| 2013/0085426 | A1 * | 4/2013 | Brodsky | A61N 5/0619 | 601/128 |
| 2015/0328491 | A1 * | 11/2015 | Miller | A63B 21/00185 | 482/82 |

OTHER PUBLICATIONS

Rakuten, "Bodimassaja comfortably back massage roller wooden body", archived from the web Jun. 9, 2011 https://web.archive.org/web/20110609043825/https://global.rakuten.com/en/store/taketora/item/ca00007/ (Year: 2011).*

Parentstalk, "Back Massager" archived from the web Feb. 1, 2003 https://web.archive.org/web/20030201133032/http://www.parents-talk.com/familyfun/crafts/crafts.html (Year: 2003).*

* cited by examiner

MASSAGE ROPE

FIELD OF THE INVENTION

Embodiments of the present invention relate generally to therapeutic technology and, more particularly, relate to apparatuses for massage therapy.

BACKGROUND OF THE INVENTION

Injuries can affect an individual's physical and mental well-being. Not only does an injury, such as leg injury, prevent a person from physically participating in certain activities, stress and depression associated with the injury can also be debilitating. Such effects are often experienced by professional athletes and often require specialized treatment to assist with recovery.

BRIEF SUMMARY OF THE INVENTION

Example embodiments including apparatuses for massaging. One example apparatus includes a first rope and a second rope. The example apparatus may also include a first handle operably coupled to a first end of the first rope and operably connected to a first end of the second rope, and a second handle operably coupled to a second end of the first rope and operably connected to a second end of the second rope. Additionally, the example apparatus may include a first massage spool assembly. The first massage spool assembly may include a first spool disposed between and secured to the first rope and the second rope, a first spool securing string connected to the first rope and the second rope, and a second spool securing string connected to the first rope and the second rope. The first spool securing string may physically engage with the first spool, and the second spool securing string may physically engage with the first spool. The first spool securing string and the second spool securing string may secure the first spool to the first rope and the second rope such that the first spool is permitted to rotate relative to the first rope and the second rope.

BRIEF DESCRIPTION OF THE DRAWINGS

Figure 1:
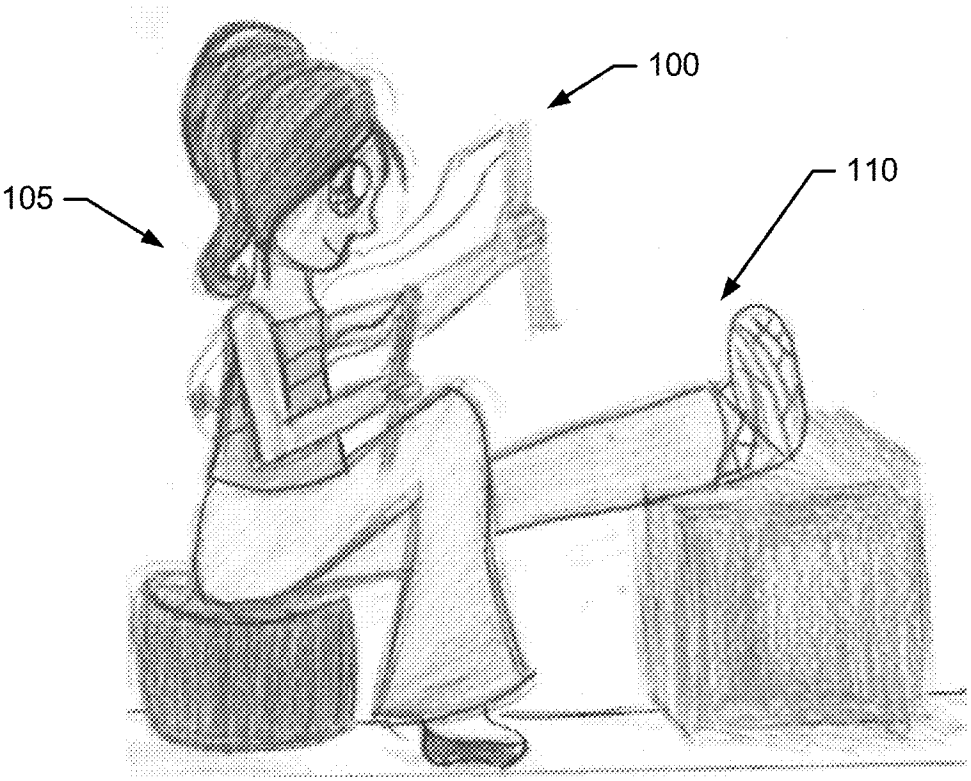
Figure 2:
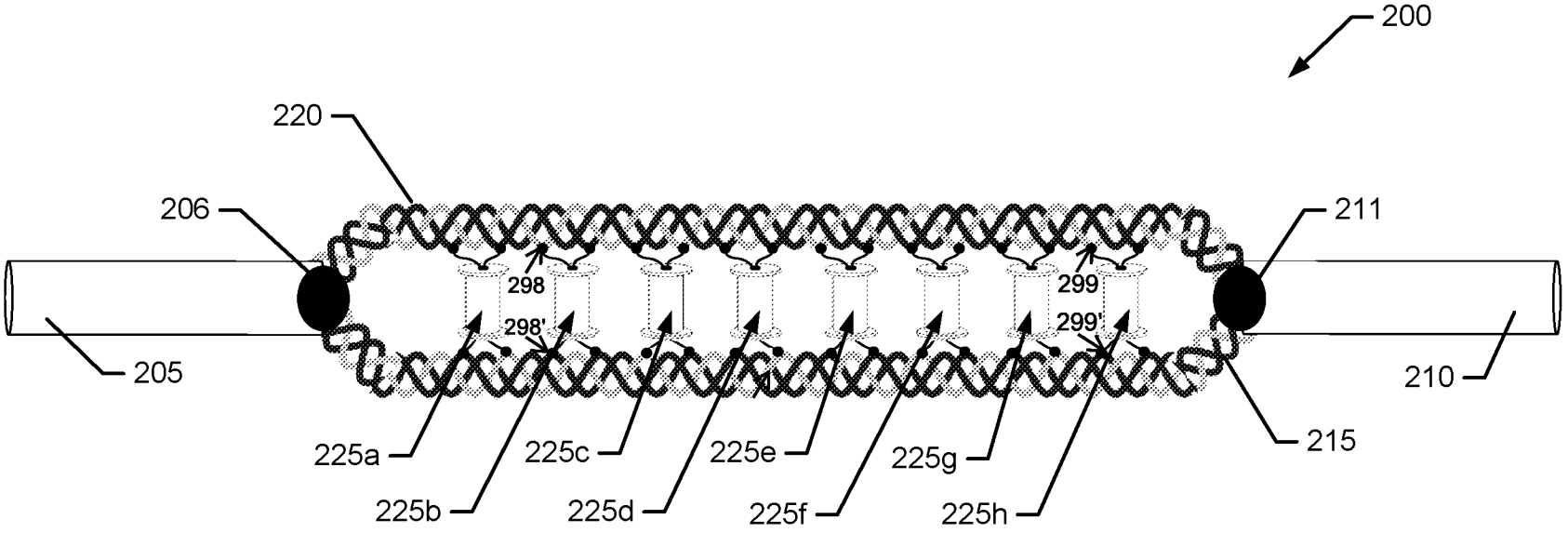
Figure 3:
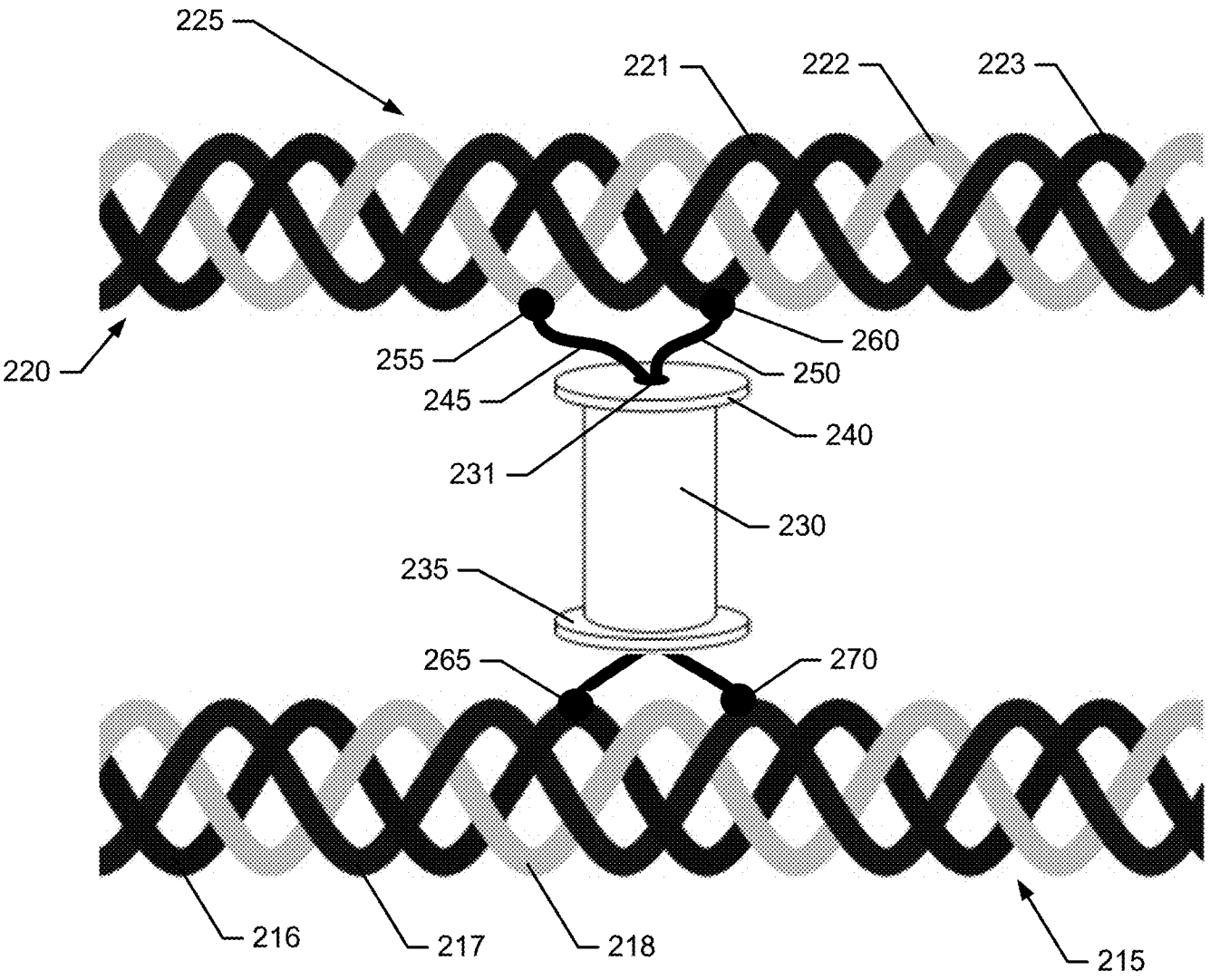

Having thus described some example embodiments in general terms, reference will now be made to the accompanying drawings, which are not necessarily drawn to scale, and wherein:

FIG. 1 shows an injured individual using an example massage rope in accordance with some example embodiments;

FIG. 2 shows an example massage rope in accordance with some example embodiments; and FIG. 3 shows an example massage spool assembly in accordance with some example embodiments.

DETAILED DESCRIPTION

Exemplary embodiments will be described more fully hereinafter with reference to the accompanying drawings, in which some, but not all embodiments of the invention are shown. Indeed, the embodiments take many different forms and should not be construed as being limiting. Rather, these example embodiments are provided so that this disclosure will satisfy applicable legal requirements. Like reference numerals refer to like elements throughout.

As described above, there is a need for therapeutic devices that can assist a person both physically and mentally when coping with a debilitating injury that requires rest to heal. For example, a leg injury, which studies indicate are experienced by 14% of basketball, soccer, and football players, can cause a professional athlete to be unable to participate in the sport. While the injured leg heals, the player may become stressed because the player cannot help her team in competition. Additionally, she may also lose coordination during this time. Further, the professional athlete may lose compensation or a starting position on the team roster because she is unable to work. As such, an apparatus that permits a person to continue to exercise and performs a massaging function to a muscle group unrelated to the injury would be desirable, because it would allow a person with an injury to stay fit and reduce their stress. The example massage rope apparatuses described herein perform at least these functions, according to some example embodiments.

Example embodiments described herein relate to a massage rope apparatus. According to some example embodiments, a massage rope may comprise two ropes with handles on either end and a plurality of rotatable spools secured to the ropes. A user may hold the handles in each hand and place the ropes and spools behind and against their back. Subsequently, the user may move the massage rope back and forth across their back such that the spools roll on the user's back and perform a massaging function. Additionally, movement of the massage rope can cause the user the exercise their arms, potentially while keeping an injured leg immobilized.

FIG. 1 shows an example massage rope in use. In this regard, a user 105 may be operating an example massage rope 100, while her injured leg 110 is immobilized. It can be seen that the user 105 may hold the handles of the massage rope 100 and move the massage rope 100 back and forth against her back thereby massaging the muscles of the back. The rolling movement of the spools may engage the muscles to increase blood flow to the back muscles thereby relaxing the muscles and also relieving mental stress. Accordingly, the movement of the spools may assist with back pain if the user 105 suffers from back pain issues.

As can be seen in FIG. 1, the massage rope 100 may be utilized while in a seated position. This permits the user to use the massage rope 100 to massage her back and exercise her arms, while also resting the injured leg 110. As seen in FIG. 1, the injured leg 110 can be immobilized and placed in an inclined position to, for example reduce swelling in the injured lag 110, while still permitting the massage rope 100 to be utilized.

FIG. 2 shows a more detailed view of an example massage rope 200, according to some example embodiments. The massage rope 200 may comprise a first handle 205, a second handle 210, a first rope 215, and a second rope 220. The massage rope 200 may also comprise a plurality of massage spool assemblies 225*a*, 225*b*, 225*c*, 225*d*, 225*e*, 225*f*, 225*g*, and 225*h*.

The first handle 205 and the second handle 210 may be constructed in the same or similar manner. In this regard, the handles 205, 210 may be made of a variety of substances, such as, for example, wood. The handles 205, 210 may be substantially cylindrical in shape and, according to some example embodiments, may have respective grip portions that permit a user to more comfortably and securely hold the handles 205, 210, while using the massage rope 200. In this regard, for example, the handles 205, 210 may have finger indentations. Each handle 205, 210 may have an end with a means 206, 211, respectively, for physically connecting the handle to the first rope 215 and the second rope 220. In this regard, the means for connecting the first rope 215 and the second rope 220 to a handle 205, 210 may be a hole in the handle, an eyelet, a hook, or the like to which the first rope 215 or the second rope 220 can be tied or otherwise affixed. According to some example embodiments, the first rope 215 and the second rope 220 may be interconnected (e.g., twisted or braided together) and the interconnected rope may be affixed the handle 205, 210.

The first rope 215 and the second rope 220 may be constructed in the same or similar manner. In this regard, the ropes 215, 220 may be comprised of a variety of materials. The material for the ropes 215, 220 may be any type of material that can be, for example, formed into cordage or a cord-like shape to be connected in a chain or braided. For example, plastic bags, such as the type used for groceries and in retail establishments, may be bunched into a cord-like shape and used as a material to form the ropes 215, 220. In this regard, the plastic bags may have already been used to deliver purchased goods, and therefore the plastic bags may be recycled or reused for the purpose of fabricating the ropes 215, 220, thereby offering an eco-friendly solution. A plurality of the plastic bags may be, for example, braided together, to obtain a desired length for the ropes 215, 220. The ropes 215, 220 may be braided in any manner that interconnects the plastic bags to increase the length of the ropes 215, 220. As shown in FIG. 2, and also in FIG. 3, the ropes 215, 220 may, for example, be braided using three strands. However, one of skill in the art would appreciate that more than three strands may be used to form the ropes 215, 220 and various braiding techniques.

As mentioned above, the first rope 215 may be operably connected to the first handle 205 at a first end of the first rope 215 at 206 and operably connected to the second handle 210 at a second end of the second rope 220 at 211. In this regard, the operable connection between the ropes 215, 220 and the handles 205, 210 may be a direct, separate connection (e.g., separately tied to the handles 205, 210) or the ropes 215, 220 may, as mentioned above, be interconnected such that a singular bundle of the first rope 215 and the second rope 220 are connected to the handles 205, 210. The connections at 206 or 211 may be, according to some example embodiments, removable to allow for the first rope 215 and the second rope 220 to be adjustable by, for example, extending the length of the first rope 215 and the second rope 220. In this regard, for example, the first rope 215 and the second rope 220 may be adjustable by braiding additional recycled plastic bags into the first rope 215 and the second rope 220.

The massage spool assemblies 225*a*-225*h* may be connected between the first rope 215 and the second rope 220 as further described with respect to FIG. 3. While the massage rope 200 is depicted with eight message rope assemblies, the massage rope 200 may include any number of massage spool assemblies according to some example embodiments. Each massage spool assembly 225*a*-225*h* may be separately connected to the first rope 215 and the second rope 220 in a manner that permits a respective spool to rotate relative to the ropes 215, 220, for example, without interacting with adjacent rotating spools, when the user is utilizing the massage rope 200. Additionally, with respect to the adjustability of the massage rope 200, additional massage spool assemblies may be added or removed, possibly in association with lengthening or shortening the first rope 215 and second rope 220, based on the needs of the user.

Additionally, because the message rope 200 is flexible, it can folded or rolled into a condensed shape and easily stowed in a small area, such as, for example, a hand bag or suitcase. Due to its portability, the message rope 200 may be carried and used in almost any environment to permit the user to maintain their exercise activities and relieve stress as described above.

FIG. 3 shows a single example massage spool assembly 225 in isolation for explanation purposes. The massage spool assembly 225 may comprise a spool 230, a first spool securing string 245 and a second spool securing string 250.

The spool 230 may be constructed of a variety of materials, such as, for example, wood. According to some example embodiments, the spool 230 may formed as a cylinder. In some example embodiments, the spool 230 may include an upper flange 240 and a lower flange 235. The upper flange 240 and the lower flange 235 may have a diameter that is larger than the diameter of a central cylinder portion. According to some example embodiments, the upper flange 240 and the lower flange 235 may have rounded edges. The spool 230 may also have a through hole 231 that extends longitudinally from a top surface of the spool 230 to a bottom surface of the spool 230. The through hole 231 may be positioned in the center of the circular areas that forms the top surface and bottom surface of the spool 230, i.e., along a center longitudinal axis of the spool 230.

The a first spool securing string 245 and a second spool securing string 250 may be constructed in the same or similar manner. In this regard, the first spool securing string 245 and the second spool securing string 250 may comprise string or twine. According to some example embodiments, the first spool securing string 245 and the second spool securing string 250 may be comprised of recycled plastic bags, similar to the first rope 215 and the second rope 220. The first spool securing string 245 and the second spool securing string 250 may be, for example, comprised of braided strands of recycled plastic bags.

To affix the spool 230 to the first rope 215 and the second rope 220, the first spool securing string 245 and the second spool securing string 250 may pass through the through hole 231 of the spool 230. The first spool securing string 245 may then be physically connected to the first rope 215 at 265 and the second rope 220 at 255. The second spool securing string 250 may then be connected to the first rope 215 at 270 and the second rope 220 at 260. The first spool securing string 245 and the second spool securing string 250 may be connected to the first rope 215 and the second rope 220 by being tied 298, 298' to the first rope 215 and the second rope 220 or being braided 299, 299' into the first rope 215 and the second rope 220. According to some example embodiments, the first spool securing string 245 may be tied to one, two, or all of the three strands 216, 217, 218 of the braided first rope 215 and to one, two, or all of the three strands 221, 222, 223 of the braided second rope 220.

While the first spool securing string 245 and the second spool securing string 250 may operate to maintain the spool 230 in connection with the first rope 215 and the second rope 220, the first spool securing string 245 and the second spool securing string 250 may also operate to maintain the lateral position of the spool 230 when a user is using the massage rope 200. Further, because the spool 230 rotates when the massage rope 200 is in use, friction between the interior wall of the through hole 231 and the first spool securing string 245 and second spool securing string 250 may occur. However, by using recycled plastic bags to form the first spool securing string 245 and the second spool securing string 250, the friction may be relatively small because the recycled plastic bags have a low coefficient of friction.

As mentioned above, a plurality of massage spool assemblies that are the same or similar to the massage spool assembly 225 may be included in a massage rope, as shown in FIG. 2. The number of massage spool assemblies may be determined based on the type of exercise that is being targeted. For example, a shorter massage rope and less massage spool assemblies may be used for a massage rope intended for a thigh massager, as opposed to a longer massage rope with relatively more massage spool assemblies for a massage rope intended to massage a person's back.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. An apparatus for massage comprising:

a first braided rope comprising one or more recycled plastic bags and extending from a first end to a second end;

a second braided rope comprising one or more recycled plastic bags and extending from a first end to a second end;

a first handle operably connected to the first ends of the first rope and the second rope;

a second handle operably connected to the second ends of the first rope and the second rope; and a first massage spool assembly comprising:

a first spool disposed between the first rope and the second rope, wherein the first spool comprises a through hole extending along a central axis thereof;

a first spool securing string extending through the through hole and connected to the first rope and the second rope; and a second spool securing string extending through the through hole and connected to the first rope and the second rope;

wherein the first spool securing string and the second spool securing string secure the first spool to the first rope and the second rope such that the first spool is rotatable relative to the first rope and the second rope about the central axis.

2. The apparatus of claim 1, wherein the first spool securing string and the second spool securing string comprise one or more recycled plastic bags.

3. The apparatus of claim 1, wherein the first spool comprises an upper flange and a lower flange.

4. The apparatus of claim 1, wherein the first spool comprises wood.

5. The apparatus of claim 1, wherein the first spool securing string is tied to the first rope and the second rope and wherein the second spool securing string is tied to the first rope and the second rope.

6. The apparatus of claim 1, wherein the first spool securing string is braided into the first rope and the second rope and wherein the second spool securing string is braided into the first rope and the second rope.

7. The apparatus of claim 1, wherein the first handle and the second handle comprise wood.

8. The apparatus of claim 1, wherein the first rope is connected to the first handle via a first connection and to the second handle via a second connection and wherein the second rope is connected to the first handle via the first connection and to the second handle via the second connection.

9. The apparatus of claim 1, wherein the second rope is tied to the first handle at first end means and to the second handle at second end means.

10. The apparatus of claim 1, wherein the first rope and the second rope are configured to be adjustable in length and configured such that each of the first rope and the second rope is adjustable by addition of braided plastic bags to each of the first rope and the second rope.

11. The apparatus of claim 1, further comprising a second massage spool assembly comprising:

a second spool disposed between the first rope and the second rope, wherein the second spool comprises a through hole extending along a central axis thereof;

a third spool securing string extending through the through hole in the second spool and connected to the first rope and the second rope; and a fourth spool securing string extending through the through hole in the second spool and connected to the first rope and the second rope;

wherein the third spool securing string and the fourth spool securing string secure the second spool to the first rope and the second rope such that the second spool is rotatable relative to the first rope and the second rope about the central axis.

12. The apparatus of claim 8, wherein at least one of the first and second connections is removable to allow for adjustments to lengths of the first rope and the second rope.

* * * * *